US010780571B2

(12) United States Patent
Taron

(10) Patent No.: US 10,780,571 B2
(45) Date of Patent: Sep. 22, 2020

(54) COLLAPSIBLE SAW HORSE

(71) Applicant: L. Michael Taron, Cottonwood, AZ (US)

(72) Inventor: L. Michael Taron, Cottonwood, AZ (US)

( * ) Notice: Subject to any disclaimer, the term of this patent is extended or adjusted under 35 U.S.C. 154(b) by 204 days.

(21) Appl. No.: 15/368,584

(22) Filed: Dec. 3, 2016

(65) Prior Publication Data

US 2017/0120439 A1 May 4, 2017

Related U.S. Application Data

(63) Continuation of application No. 12/777,039, filed on May 10, 2010, now Pat. No. 9,512,627.

(51) Int. Cl.
*B25H 1/06* (2006.01)
*B25H 1/04* (2006.01)
*E04G 1/34* (2006.01)

(52) U.S. Cl.
CPC ..... *B25H 1/06* (2013.01); *B25H 1/04* (2013.01); *E04G 1/34* (2013.01)

(58) Field of Classification Search
CPC ..... B25H 1/04; B25H 1/06; B25H 1/02
USPC ..... 182/155, 181.1, 186.2, 186.4, 224, 153
See application file for complete search history.

(56) References Cited

U.S. PATENT DOCUMENTS 295,269 A * 3/1884 Miller ..... B25H 1/06 182/153
319,723 A * 6/1885 Hughes ..... B25H 1/06 182/185.1
862,725 A * 8/1907 Fietsam ..... B25H 1/06 182/155
1,682,671 A * 8/1928 Gooding ..... E04G 1/34 182/186.2
2,427,679 A * 9/1947 Larson ..... B25H 1/06 182/153
2,828,165 A * 3/1958 Harter ..... B25H 1/06 182/153
3,282,379 A * 11/1966 Jones ..... B25H 1/06 182/155
3,443,662 A * 5/1969 Thompson ..... E04G 1/34 182/155
3,529,697 A * 9/1970 White ..... B25H 1/06 182/186.2
3,716,112 A * 2/1973 Lake ..... B25H 1/06 182/155
3,741,338 A * 6/1973 Durand ..... B66C 19/02 182/155

(Continued)

FOREIGN PATENT DOCUMENTS

DE 202011106462 U1 * 1/2012 ..... A47C 9/10
EP 0391115 A2 * 10/1990 ..... B23D 57/0092
FR 2898399 A1 * 9/2007 ..... B25H 1/06

*Primary Examiner* — Katherine W Mitchell
*Assistant Examiner* — Candace L Bradford
(74) *Attorney, Agent, or Firm* — Inspired Idea Solutions Law Firm; Wayne Carroll

(57) ABSTRACT

A saw horse may include a center beam, a first leg connected to the center beam, and a second leg connected to the center beam. The first leg may rotate and may traversely extend and retract to move between an open and a stowed position. The second leg may rotate and traversely extend and retract to move between the open and the stowed position. The saw horse may include a flexible axis biasing device to connect to the first leg. The saw horse may include a flexible axis biasing device to connect to the second leg.

30 Claims, 30 Drawing Sheets

(56) References Cited

U.S. PATENT DOCUMENTS 3,817,349 A * 6/1974 Barthel ..... B25H 1/06 182/155
4,030,565 A * 6/1977 Chaput ..... B25H 1/06 182/151
4,182,432 A * 1/1980 Cossitt ..... B25H 1/06 182/151
4,325,463 A * 4/1982 Taylor ..... B25H 1/06 182/155
4,403,678 A * 9/1983 Zieg ..... B25H 1/06 182/153
4,429,765 A * 2/1984 Garcia ..... B25H 1/06 182/153
4,771,863 A * 9/1988 Stansberry ..... B25H 1/06 182/155
4,819,762 A * 4/1989 Osborne, Sr. ..... B25H 1/06 182/153
4,967,877 A * 11/1990 Wallman ..... B25H 1/06 182/155
5,119,903 A * 6/1992 Ulshafer, Jr. ..... B25H 1/06 182/155
5,377,779 A * 1/1995 Slapnicka ..... B25H 1/06 182/153
5,560,448 A * 10/1996 Yemini ..... B25H 1/06 182/153
6,640,930 B1 * 11/2003 Peters ..... B25H 1/06 182/151
7,172,053 B2 * 2/2007 Slavich ..... B25H 1/06 182/153
2004/0188178 A1 * 9/2004 Slemmer ..... B25H 1/04 182/154
2006/0124395 A1 * 6/2006 Fisher ..... B25H 1/06 182/153
2006/0162627 A1 * 7/2006 Alger ..... A47B 3/087 108/169
2007/0221817 A1 * 9/2007 Chen ..... B25H 1/04 248/676
2008/0035427 A1 * 2/2008 Fowler ..... B25H 1/06 182/153
2008/0173498 A1 * 7/2008 Beyor ..... B25H 1/06 182/153
2009/0013923 A1 * 1/2009 Lund ..... E01F 13/02 116/63 P

* cited by examiner

COLLAPSIBLE SAW HORSE

CROSS-REFERENCES TO RELATED APPLICATIONS

The present application claims priority to U.S. application Ser. No. 12/777,039 filed on May 10, 2010, now issued as U.S. Pat. No. 9,512,627, issued on Dec. 6, 2016 and titled Collapsible Saw Horse.

FIELD

The present disclosure relates to a saw horse and more particularly to a saw horse having legs which may pivot and be folded to a compact footprint.

BACKGROUND

The use of saw horse devices is known in the prior art. More specifically, saw horse devices heretofore utilized are known to consist basically of familiar, expected and structural configurations, notwithstanding the myriad of designs encompassed by the crowded prior art which have been developed for the fulfillment of countless objectives and requirements.

The saw horse is a general purpose support device well known in the construction trades. A typical saw horse includes two pairs of legs with a cross beam mounted between the pairs, each pair of legs describing a generally triangular shape with the ground. At least one board may be disposed on top of a pair of saw horses, either as a work piece or as a work surface or as a small scaffolding. The portability, versatility, and economical construction of saw horses provide great utility.

Various modifications in the design and construction of saw horses have been proposed to accomplish these objectives.

Accordingly, a need remains for a saw horse that is that is sturdy and durable, yet easy to set-up, use, and store.

SUMMARY

A saw horse may include a center beam, a first leg connected to the center beam, and a second leg connected to the center beam.

The first leg may rotate and may traversely extend and retract to move between an open and a stowed position.

The second leg may rotate and traversely extend and retract to move between the open and the stowed position.

The saw horse may include a flexible axis biasing device to connect to the first leg.

The saw horse may include a flexible axis biasing device to connect to the second leg.

The saw horse may include a leg spacer to space the first leg and the second leg.

The first leg may include a notch to cooperate with the leg spacer.

The second leg may include a notch to cooperate with the leg spacer.

The first leg and the second leg may be nestable.

The saw horse may include a flexible handle connected to the center beam.

The saw horse may include a leg latch.

The saw horse may include a leg latch catch.

BRIEF DESCRIPTION OF THE DRAWINGS

The disclosed embodiments may be understood by reference to the following description taken in conjunction with the accompanying drawings, in which, like reference numerals identify like elements, and in which.

DETAILED DESCRIPTION

The disclosed embodiments include a collapsible/foldable saw horse design that is strong, light weight, easy and quick to collapse for storage and to open up for use. The saw horse is very compact with regular angles for example rectangular in a storage section which allows for stacking of multiple units or standing on either end occupying very little floor area for storage.

The disclosed embodiments include a flexible axis spring which attaches the legs to the beam and serves as an axis on which the legs may turn when moving between the storage and in use positions. The flexible axis spring allows the angle of attachment, the length of the axis and the tension on connection to change in variable amounts as legs are moved from flat against the beam (substantially parallel) to be angularly opposed to the beam while being used. The legs may be positioned longitudinally and stabilized while in the open position where a horizontal cross latch locks the legs into position while the notches of the legs cooperate with the spreaders on the beam.

The flexible axis spring allows a range of angles of opposition and angular disposition of the legs with respect to each other.

The saw horse according to some embodiments may be formed from planar material such as wood and results in a light weight compact saw horse in storage which is easy and quick to fold and unfold.

The legs and center beam can employ I beam/T beam technology to allow for leg design that may overlay one leg to another to lie side-by-side against the beam for compact storage. Alternatively, a nesting design can be employed. The saw horse handle facilitates stacking of multiple units and is comfortable to the hand. Alternatively, a rigid handle could be used.

The disclosed embodiments can be used with a bracket to provide increased strength, especially in applications using wood for the beams and legs. The brackets allow for a broken beam or legs to be changed in case of damage. Furthermore, the bracket provides a low-cost unassembled unit.

It has long been noted that the convenience and functionality of the saw horse may be improved by departing from rigid structural designs. It has been found desirable to provide the saw horse with pivoting or collapsible members for convenient storage. It is further desirable to construct a saw horse from light weight materials to provide ease in transportation. Yet another desirable feature is some means for maintaining the saw horse in a stable and balanced position on a sloping ground surface.

Figure 1:
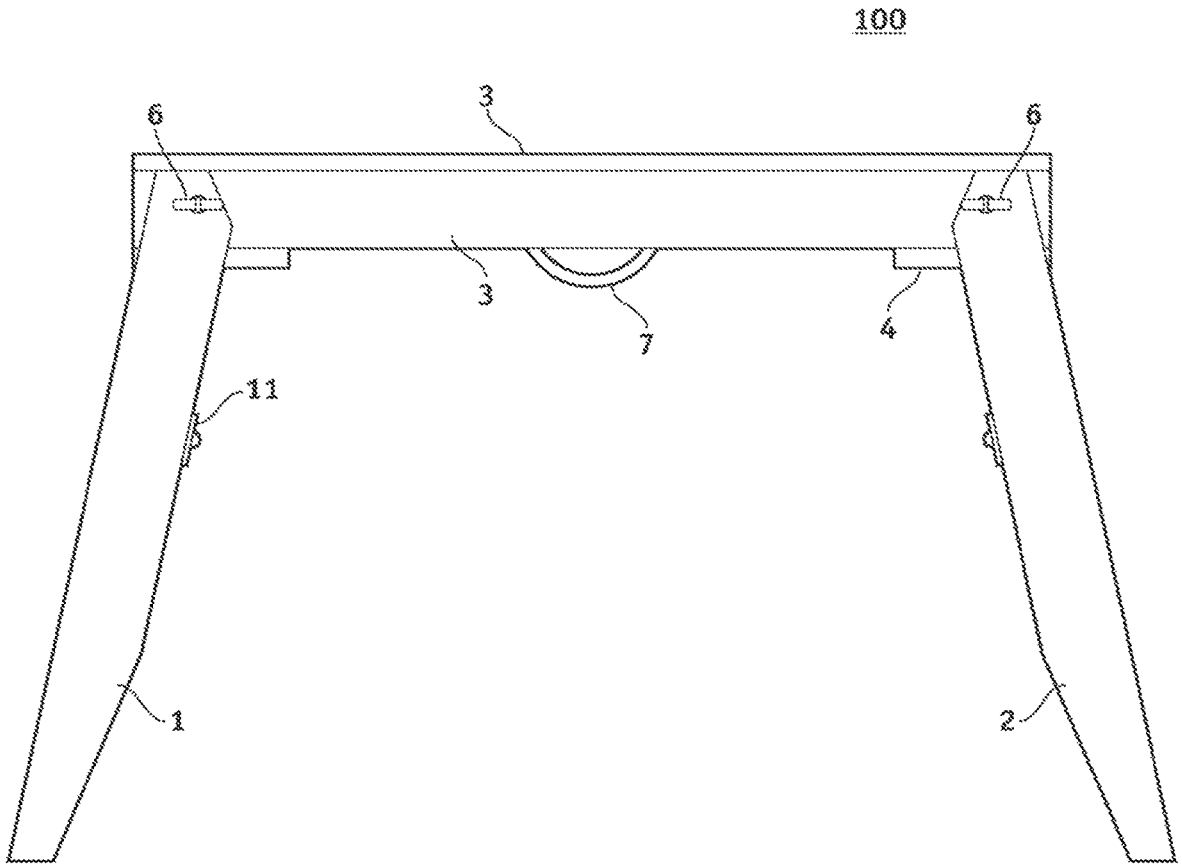
FIG. 1 illustrates a side view of the saw horse according to some embodiments.

FIG. 1 illustrates a saw horse 100 which may include a first leg 1 and a second leg 2. The first leg 1 and the second leg 2 may include a mirrored first leg 1 and a mirrored second leg 2 which may oppose the first leg 1 and the second leg 2 on the back side of the saw horse 100. The first leg 1 and the second leg 2 may include a tapered portion, and FIG. 1 illustrates the first leg 1 and the opposing second leg 2 being positioned with an angled relationship with the center beam 3. The first leg 1 and the second leg 2 may independently pivot and may extend and retract in the traverse direction with respect to the center beam 3. The first leg 1 and the second leg 2 may pivot to a position substantially parallel to the longitudinal direction of the center beam 3 in order to collapse to a stowed position (not shown in FIG. 1). The center beam 3 may be sandwiched between the first leg 1 and the mirrored first leg 1 and may be sandwiched between the second leg 2 and the mirrored second leg 2. The first leg 1 and the mirrored first leg 1 may be connected to a flexible axis biasing device 5, not shown in FIG. 1, which may be a spring; likewise the second leg 2 and the mirrored second leg 2 may be connected to another flexible axis biasing device 5, not shown in FIG. 1, which may allow the first leg 1 and the second leg 2 to extend and retract in a traverse direction and to bias the first leg 1 and the second leg 2 inwards towards the center beam 3. A leg spacer 4 may be positioned between the first leg 1 and the mirrored first leg 1 and also a second leg spacer may be positioned between the second leg 2 and the mirrored second leg 2 in order to position the first leg 1 and the second leg 2. A retainer pin 6 may extend through respective ends of the flexible axis biasing device 5, not shown in FIG. 1 in order to fasten the first leg 1 and the second leg 2 to the center beam 3. FIG. 1 additionally illustrates a leg latch 11 which may be positioned along the first leg 1 or alternatively the second leg 2 and may be conveniently positioned at approximately the midpoint of the first leg 1 or the second leg 2. The leg latch 11 may restrain either the first leg 1 or the second leg 2 wherein the first leg 1 or the second leg 2 is in an opened position. FIG. 1 additionally illustrates a flexible handle 7 which may be positioned along the bottom of the center beam 3 in order to provide for convenient carrying of the saw horse 100 and is shown substantially centered on the center beam 3.

Figure 2A:
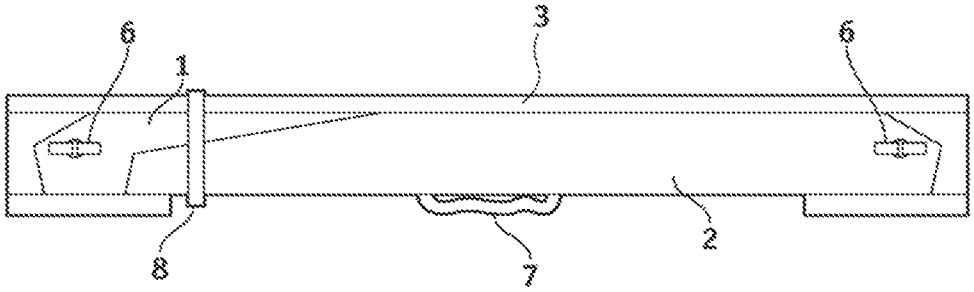
FIG. 2*a* illustrates a first side view of the saw horse shown in FIG. 1 in a closed position.

FIG. 2*a* shows the first leg 1 and the second leg 2 in a stowed position and shows a fastening device 8 for fastening the first leg 1 and the second leg 2 to the center beam 3, and the fastening device 8 may be a strap which may extend around the first leg 1, the second leg 2 and the center beam 3. Also illustrated is the retainer pin 6, and the flexible handle 7.

Figure 2B:
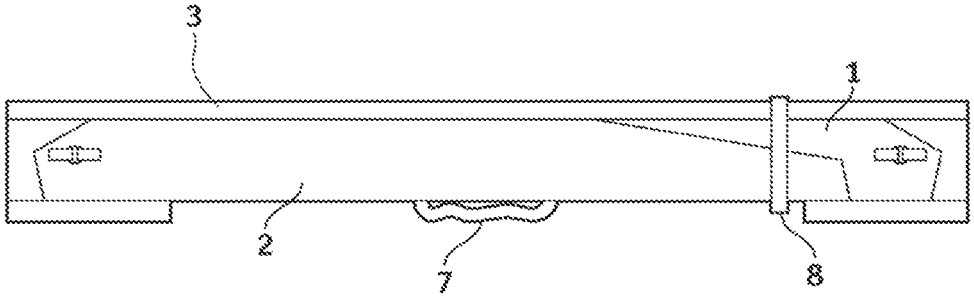
FIG. 2*b* illustrates a second side view of the saw horse shown in FIG. 1 in a closed position.

FIG. 2*b* shows the mirrored first leg 1 and the mirrored second leg 2 in a stowed position and shows a fastening device 8 for fastening the mirrored first leg 1 and the mirrored second leg 2 to the center beam 3, and the fastening device 8 may be a strap which may extend around the mirrored first leg 1, the mirrored second leg 2 and the center beam 3. Also illustrated are the retainer pin 6 and the flexible handle 7. The flexible handle 7 is shown collapsed in FIG. 2*a* and FIG. 2*b*.

Figure 3A:
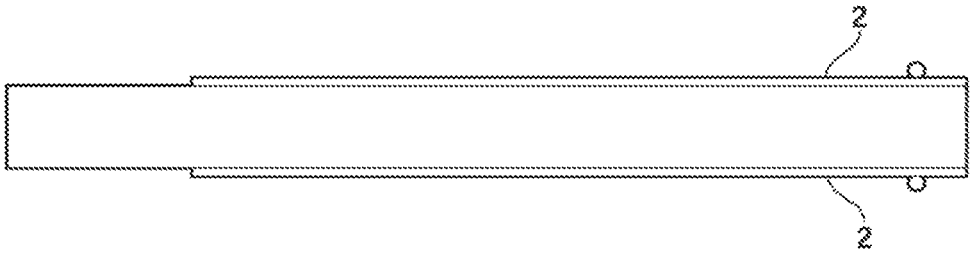
FIG. 3*a* illustrates a top view of the saw horse shown in FIG. 1 in a closed position.

FIG. 3*a* illustrates a top view of the center beam, the mirrored second leg 2, and the second leg 2 in a stowed position.

Figure 3B:
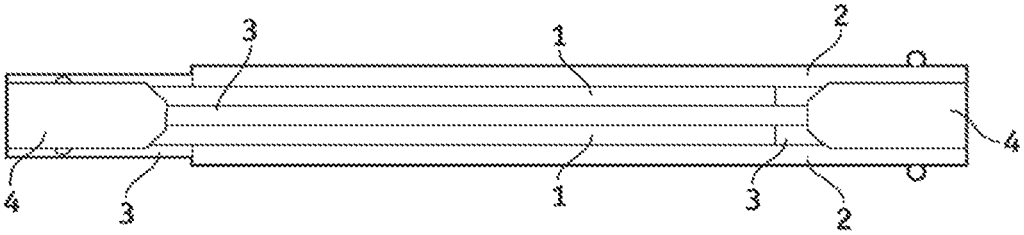
FIG. 3*b* illustrates a bottom view of the saw horse shown in FIG. 1 in a closed position.

FIG. 3*b* illustrates a bottom view of the center beam 3, the second leg 2 on the outside and adjacent to the first leg 1 which may be adjacent to the center beam 3 which may be adjacent to the mirrored first leg 1, which may be adjacent to the mirrored second leg 2, which may be on the outside. The leg spacer 4 is additionally shown in FIG. 3*b*.

Figure 4:
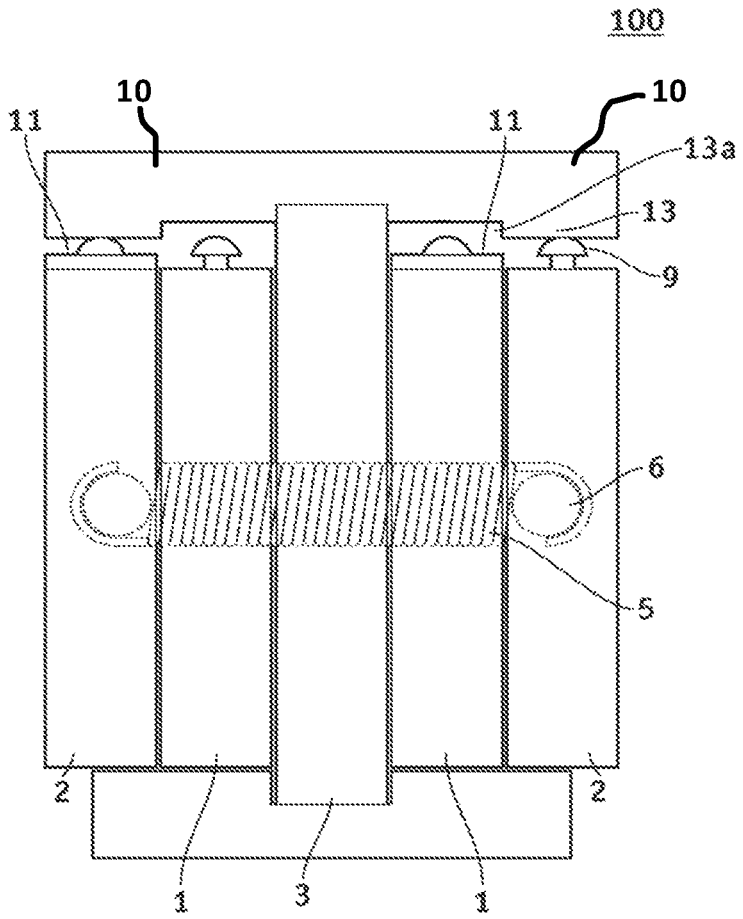
FIG. 4 illustrates an end view from a first end of the saw horse shown in FIG. 3*b* in a closed position.

FIG. 4 illustrates an end (left side in FIG. 3*b*) of the saw horse 100 in a stowed position and illustrates the second leg 2 on the outside, going from right to left, and adjacent to the first leg 1 which may be adjacent to the center beam 3 which may be adjacent to the mirrored first leg 1, which may be adjacent to the mirrored second leg 2 which may be on the outside. FIG. 4 additionally illustrates that the flexible axis biasing device 5 extends through the first leg 1, the center beam, and the mirrored first leg 1, and is connected to the retaining pin 6 at each end. FIG. 4 further illustrates the top leg guide 13 and a stop recess 13a to guide the first and mirrored first legs. The beam 3 may include a center portion and a work piece-supporting flange 10, that together create a "T" shape along at least a portion of the beam 3. The leg spacer 4 may extend from the bottom of the beam 3 as a leg separating- flange, and form an "I" shape with the beam 3 and work piece-supporting flange 10 at least along a portion of the beam 3, when viewed from the end as shown in FIG. 4, FIG. 5, FIG. 6, FIG. 8, FIG. 15, FIG. 16, FIG. 25, FIG. 27, FIG. 31, FIG. 33, FIG. 35*a*, FIG. 35*b*, FIG. 37*a*, and FIG. 37*b*.

Figure 5:
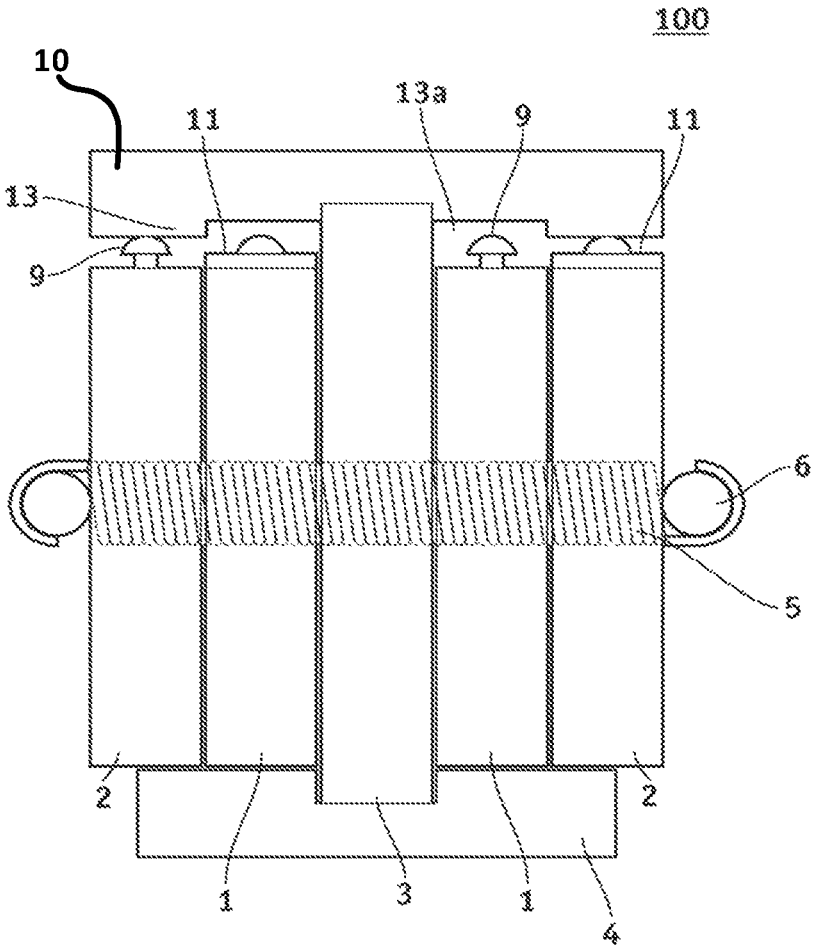
FIG. 5 illustrates another end view from a second end of the saw horse shown in FIG. 3*b* in a closed position.

FIG. 5 illustrates an end (right side in FIG. 3*b*) of the saw horse 100 in a stowed position and illustrates the mirrored second leg 2 (going from right to left) on the outside and adjacent to the mirrored first leg 1 which may be adjacent to the center beam 3 which may be adjacent to the first leg 1, which may be adjacent to the second leg 2 which may be on the outside. FIG. 5 additionally illustrates that the flexible axis biasing device 5 extends through the mirrored second leg 2, the center beam 3, and the second leg 2 and is connected to the retaining pin 6 at each end. FIG. 5 further illustrates the top leg guide 13 and a stop recess 13a to guide the mirrored second leg 2 and the second leg 2, and the leg latch catch 9.

Figure 6:
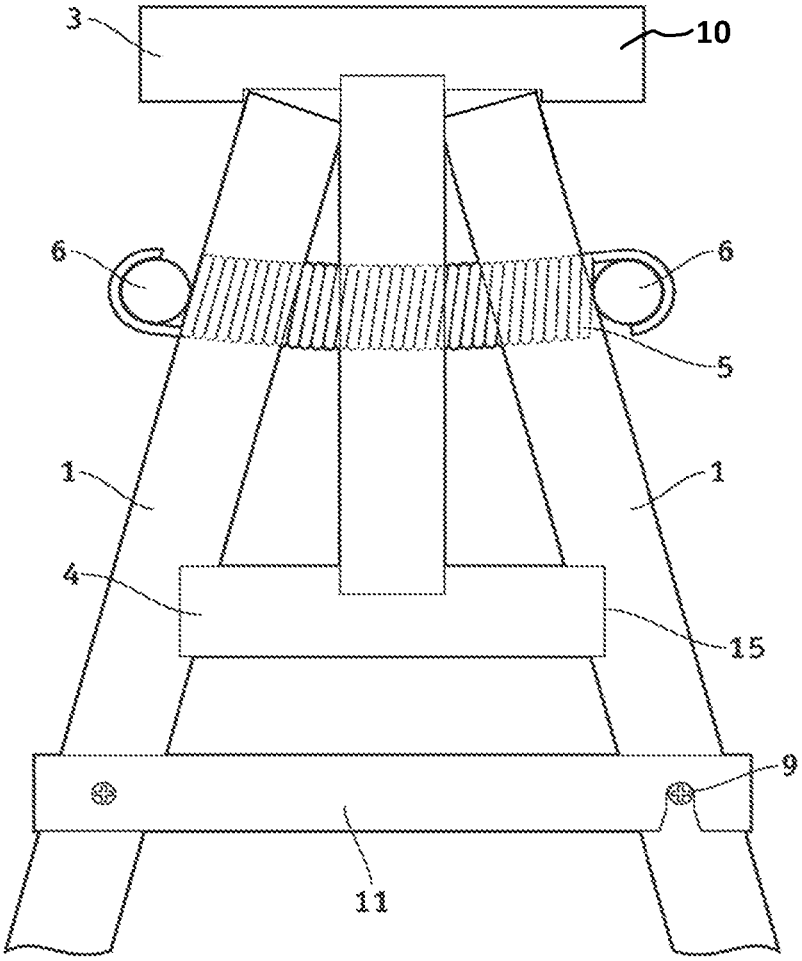
FIG. 6 illustrates an end view of a portion of the end of the saw horse shown in FIG. 3*b* in an open position.

FIG. 6 illustrates an end of the saw horse (left side in FIG. 3*b*) showing that the first leg 1 and the mirrored first leg 1 may be at an angled relationship with respect to the center beam 3 and illustrates that the first leg 1 and the mirrored first leg 1 may include a leg stabilization notch 15 which may be positioned on the interior surface of the first leg 1 and the mirrored first leg 1 in order to cooperate with the leg spacer 4 which may space and stabilize the first leg 1 and the mirrored first leg 1. FIG. 6 additionally illustrates that the flexible axis biasing device 5 may be approximately arc-shaped in order to allow the first leg 1 and the mirrored first leg 1 to extend outwards. FIG. 6 additionally illustrates a leg latch 11 which is pivotally connected to one of the first leg 1 or the mirrored first leg 1 and the other leg 1, mirrored leg 1 may include a catch 9 to allow the leg latch to connect and support the legs 1, mirrored leg 1.

Figure 7:
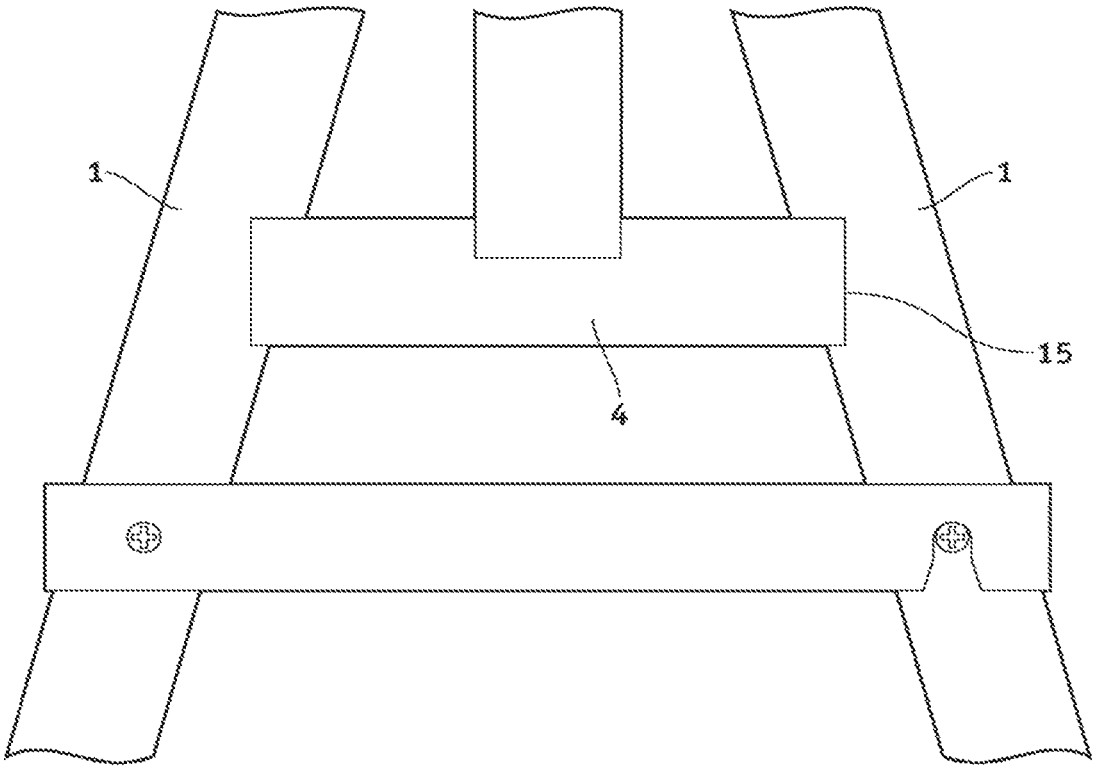
FIG. 7 illustrates an end view of another portion of the end of the saw horse shown in FIG. 6 in an open position.

FIG. 7 illustrates that the first leg 1 and the mirrored first leg 1 may include a leg stabilization notch 15 which may be positioned on the interior surface of the first leg 1 and the mirrored first leg 1 in order to cooperate with the leg spacer 4 which may space and stabilize the first leg 1 and the mirrored first leg 1.

Figure 8:
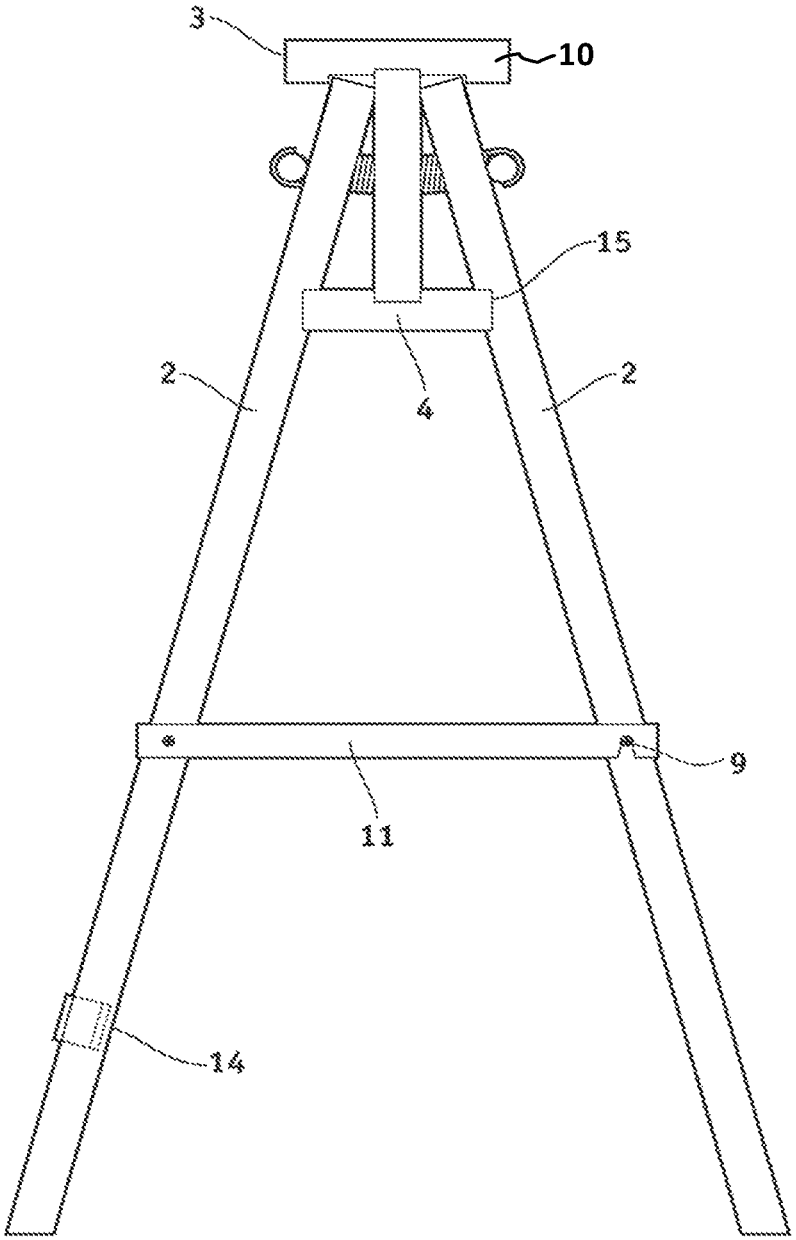
FIG. 8 illustrates an end view of the end of the saw horse including the portion of FIG. 7.

FIG. 8 illustrates that the second leg 2 and the mirrored second leg 2 (right side in FIG. 3*b*) may be at a angled relationship with respect to the center beam 3 and illustrates that the second leg 2 and the mirrored second leg 2 may include a leg stabilization notch 15 which may be positioned on the interior surface of the second leg 2 and the mirrored second leg 2 in order to cooperate with the leg spacer 4 which may space and stabilize the second leg 2 and the mirrored second leg 2. FIG. 6 additionally illustrates that the flexible axis biasing device 5 may be approximately arc-shaped in order to allow the second leg 2 and the mirrored second leg 2 to extend outwards. FIG. 8 additionally illustrates a leg latch 11 which is pivotally connected to one of the second leg 2 or the mirrored second leg 2, and the other leg 2, mirrored leg 2 may include a catch 9 to allow the leg latch to connect and support the legs 2, mirrored leg 2. FIG. 8 additionally illustrates a leg latch retainer clip 14 to be used when the legs 1, 2 are in a stowed position. The leg latch retainer clip 14 attaches to the leg and holds the leg latch 11 stowed against the leg when the saw horse is in the stowed position.

Figure 9:
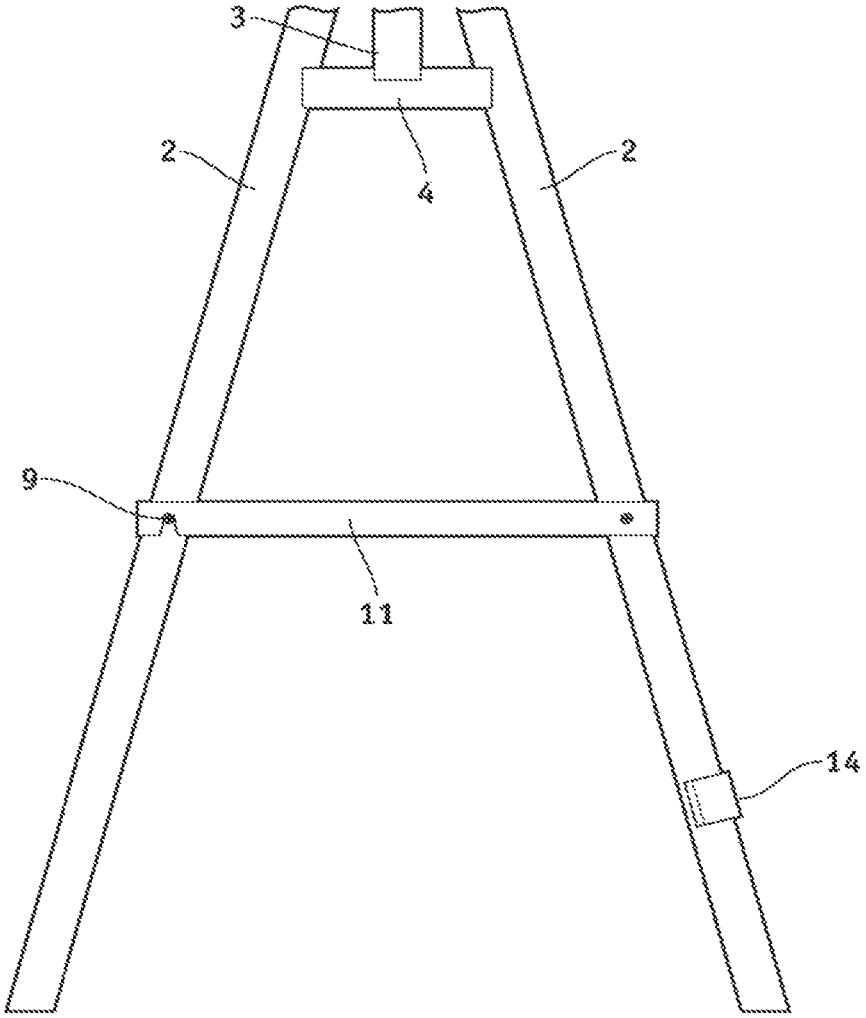
FIG. 9 illustrates an end view of another portion of the end of the saw horse shown in FIG. 7.

FIG. 9 illustrates a end view of the leg latch catch 9 to releasably hold the legs 1, mirrored leg 1 in an open position and to release the legs 1, mirrored leg 1 so that the legs 1, mirrored leg 1 can be placed at adjacent and stowed. The leg catch 9 cooperates with the leg latch 11 which may pivot. FIG. 9 additionally illustrates the spacer 4.

Figure 10:
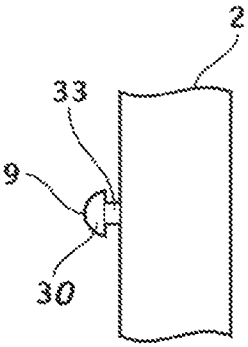
FIG. 10 illustrates a side view of the leg latch catch of the saw horse shown in FIG. 9.

FIG. 10 illustrates a side view of the leg 2 which may include the leg latch catch 9 which may include a mushroom shaped head 30 which may be mounted on a rod 33 which may extend into the leg 2.

Figure 11:
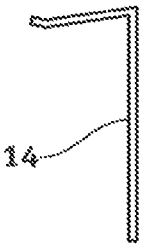
FIG. 11 illustrates a side view of the leg latch retainer clip of the saw horse shown in FIG. 9.

FIG. 11 illustrates a side view of the leg latch retainer clip 14 which may be substantially L-shaped.

Figure 12:
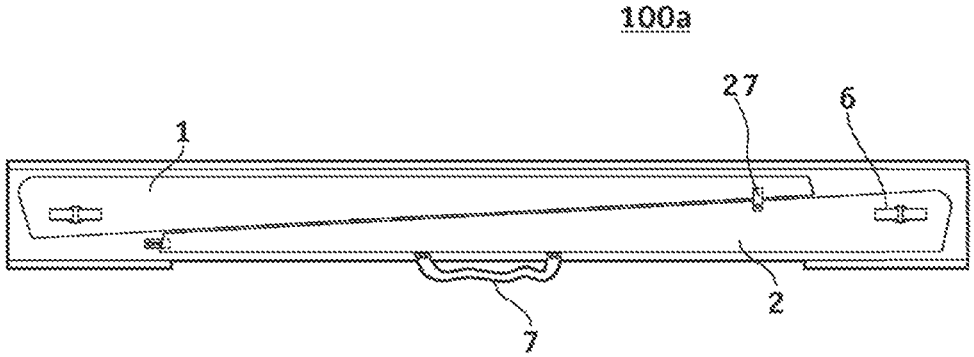
FIG. 12 illustrates a side view of a folded saw horse in a closed position.

FIG. 12 illustrates another embodiment of side-by-side legs 1, 2. The saw horse 100*a* is illustrated in a side view and in a stowed position with the leg retainer tab 27.

Figure 13:
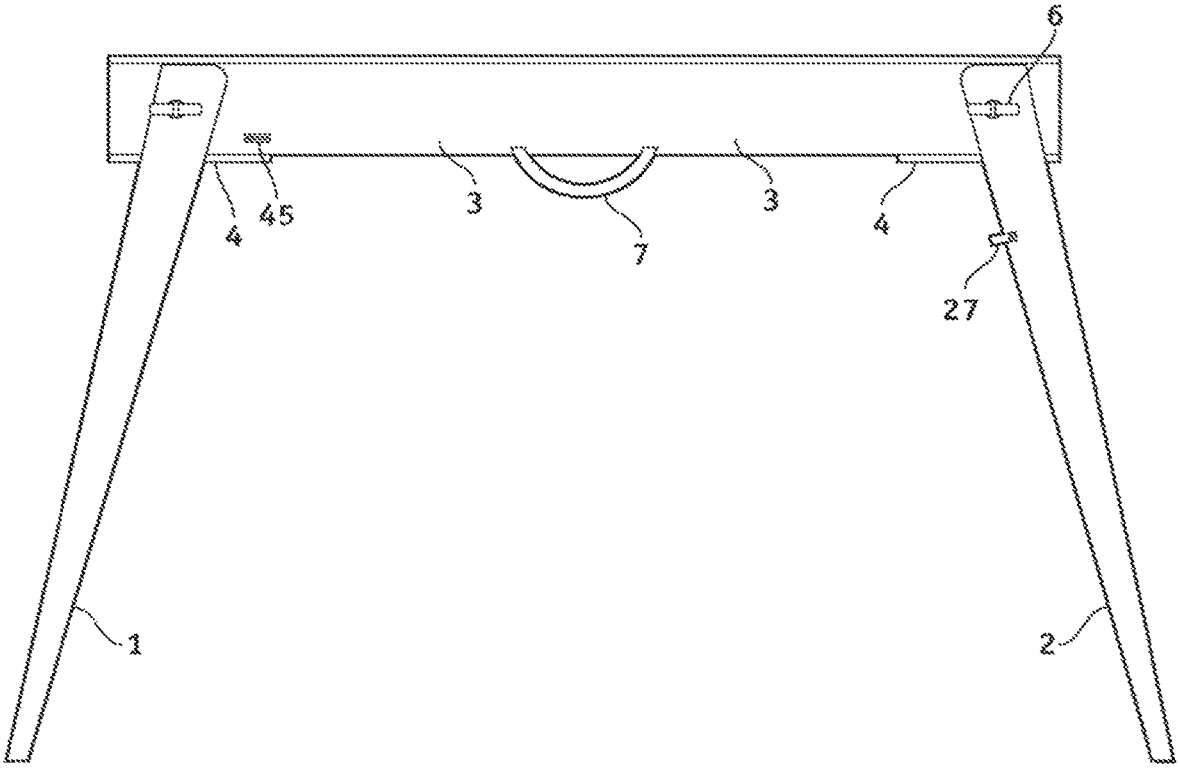
FIG. 13 illustrates a side view of the saw horse show in FIG. 12 in the open position.

FIG. 13 illustrates the legs 1, 2, the center beam 3, the leg spacer 4, the retainer pins 6, the flexible handle 7, the fastener device 45 and the leg retainer tab 27.

Figure 14:
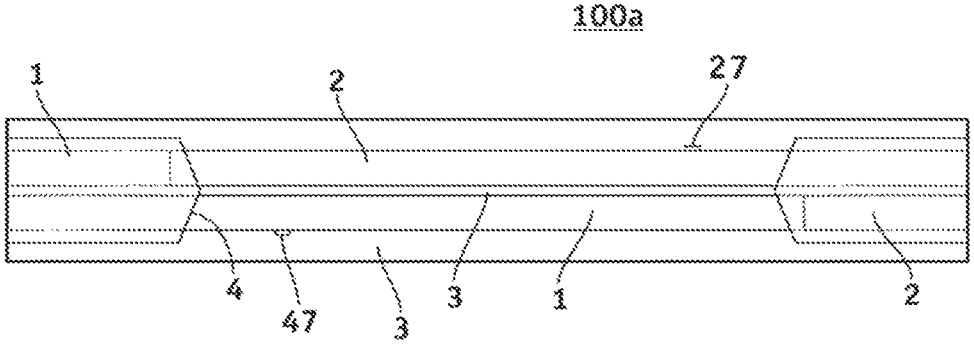
FIG. 14 illustrates a bottom view of the saw horse shown in FIG. 12.

FIG. 14 illustrates a bottom view of the saw horse 100*a* and FIG. 14 illustrates the second leg 2 and the mirrored first leg 1 the center beam 3, the leg spacer 4, and the leg retainer tab 27.

Figure 15:
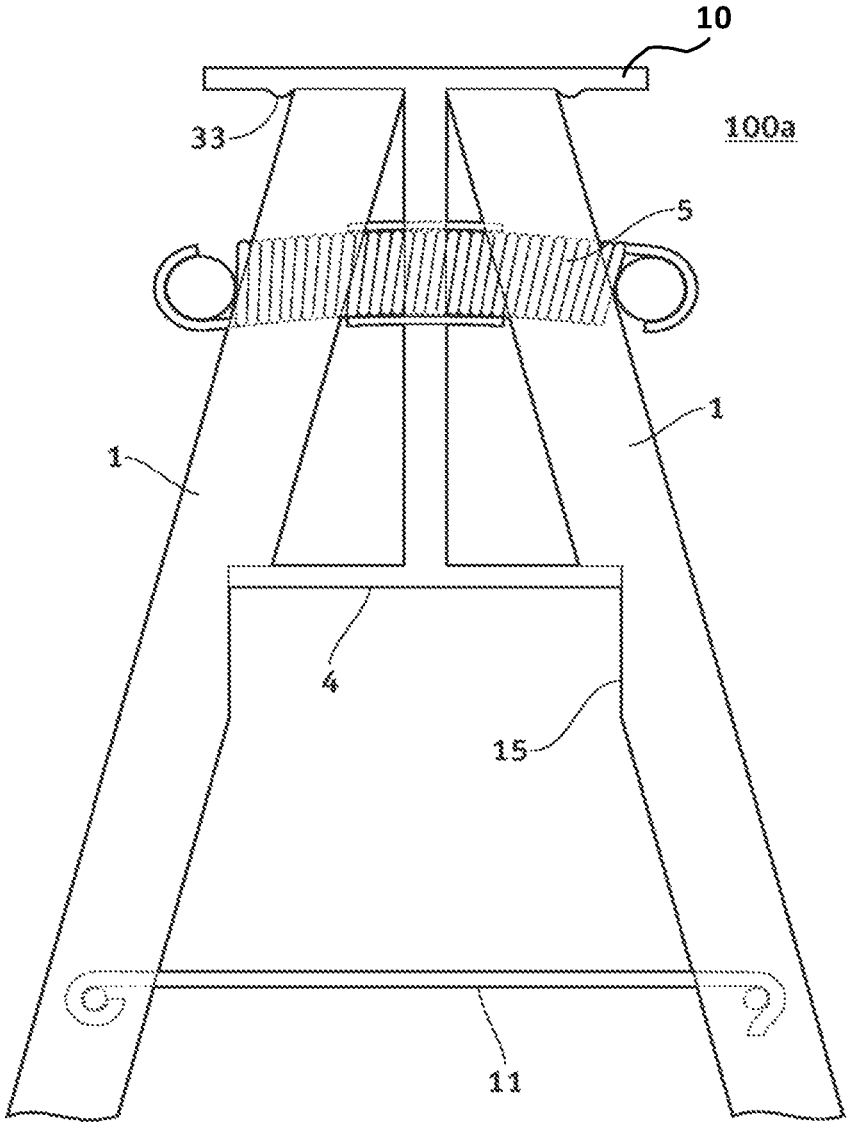
FIG. 15 illustrates an end view of a portion of the saw horse shown in FIG. 12.

FIG. 15 illustrates an end view and illustrates that the saw horse 100*a* is in the open position. FIG. 15 illustrates the leg spacer 4, the flexible axis biasing device 5, the guide and stop 33 for the leg top, the leg latch 11 to maintain the legs 1, mirrored leg 1 in an open position, and a leg stabilizer notch 15.

Figure 16:
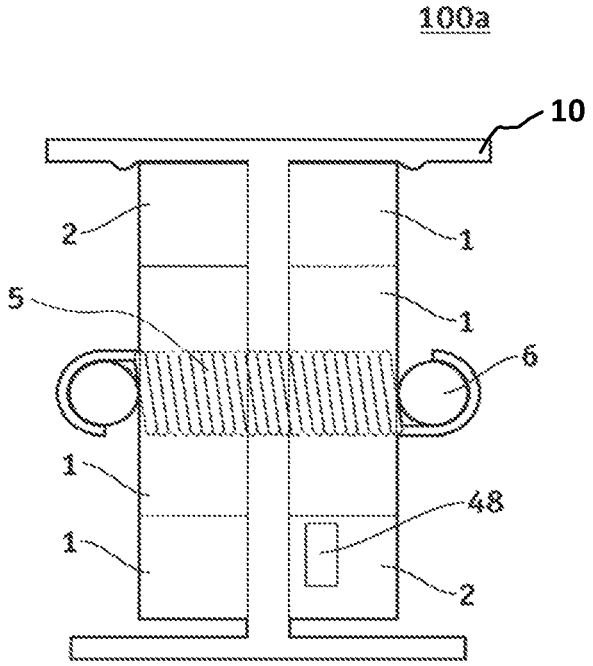
FIG. 16 illustrates an end view of the saw horse shown in FIG. 12 in a closed position.

FIG. 16 illustrates an end view of the saw horse 100*a* according to some embodiments and illustrates the first leg 1, the second leg, a receiver slot 48 that cooperates with the leg retainer sliding flat bolt to hold the leg against the beam in stowed position, the flexible axis biasing device 5 and the retainer pin 6.

Figure 17:
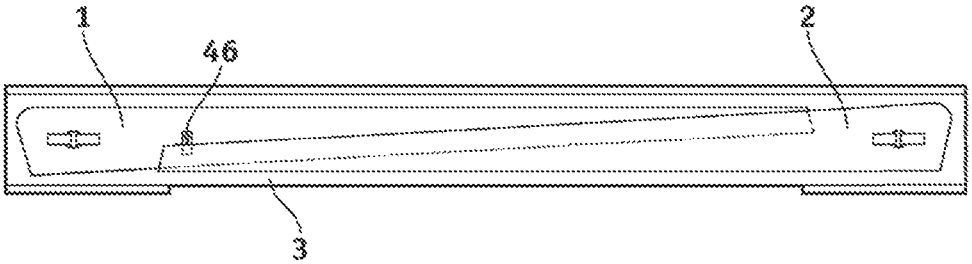
FIG. 17 illustrates a side view of a saw horse according to some embodiments in a closed position.

FIG. 17 illustrates nesting legs 1, 2 which are in a stowed position FIG. 17 illustrates second leg 2 may be at an exterior position, first leg one may be between the second leg 2 and the center beam 3.

Figure 18:
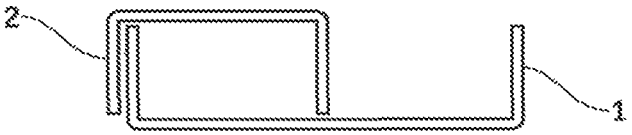
FIG. 18 illustrates an end view of the first and second legs of the saw horse of FIG. 17 in a closed nesting position.

FIG. 18 illustrates a end view of the first leg 1 which may be substantially U-shaped and a opposed second leg 2 which may be substantially U-shaped. The first leg 1 may be nested with the second leg 2.

Figure 19:
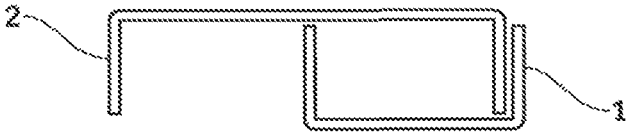
FIG. 19 illustrates another end view of the first and second legs of the saw horse of FIG. 17 in a closed nesting position.

FIG. 19 illustrates an opposing end view of the first leg 1 which may be substantially U-shaped and a opposed second leg 2 which may be substantially U-shaped. The first leg 1 may be nested with the second leg 2.

Figure 20:
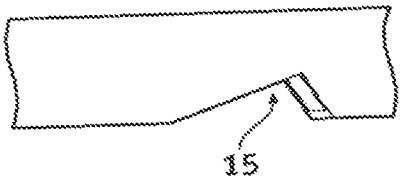
FIG. 20 illustrates a perspective view of a portion of a leg of the saw horse according to FIG. 17.

FIG. 20 illustrates a perspective view of the leg 2 and the notch 15.

Figure 21:
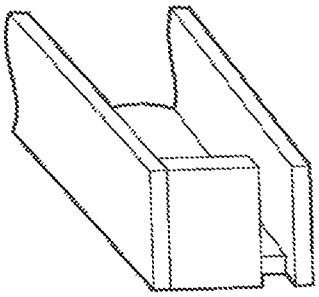
FIG. 21 illustrates a perspective view of the foot of a leg showing the gap that allows the legs to nest according to the embodiment illustrated in FIG. 17.

FIG. 21 illustrates a perspective view of the foot of a leg showing the gap that allows the legs to nest.

Figure 22:
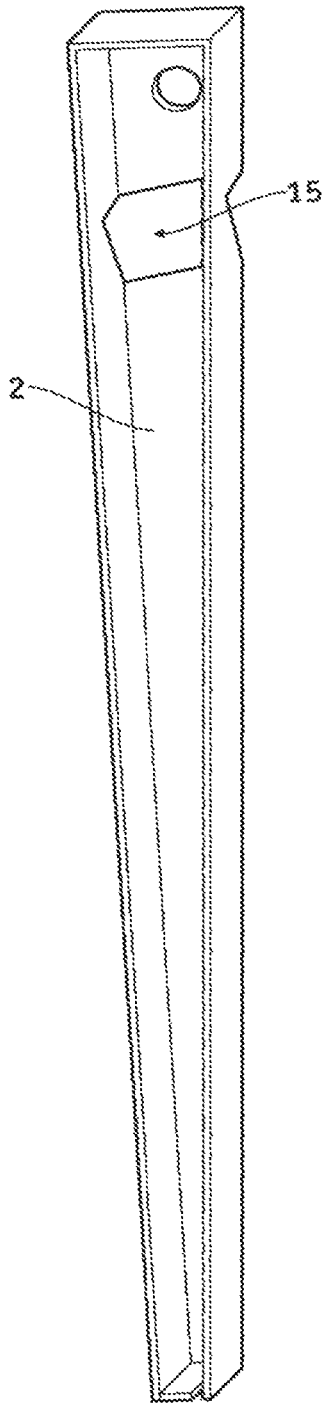
FIG. 22 illustrates a perspective view of a leg of the saw horse according FIG. 17.

FIG. 22 illustrates a perspective view of the second leg 2 and the notch 15.

Figure 23:
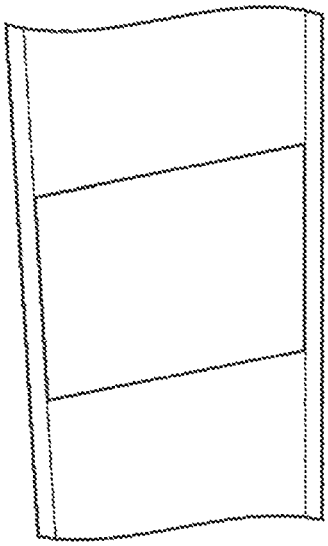
FIG. 23 illustrates a side view of a portion of the nesting legs of the saw horse according FIG. 17.

FIG. 23 is a close up drawing of the void in the u-channel created by the retainer notch formation.

Figure 24:
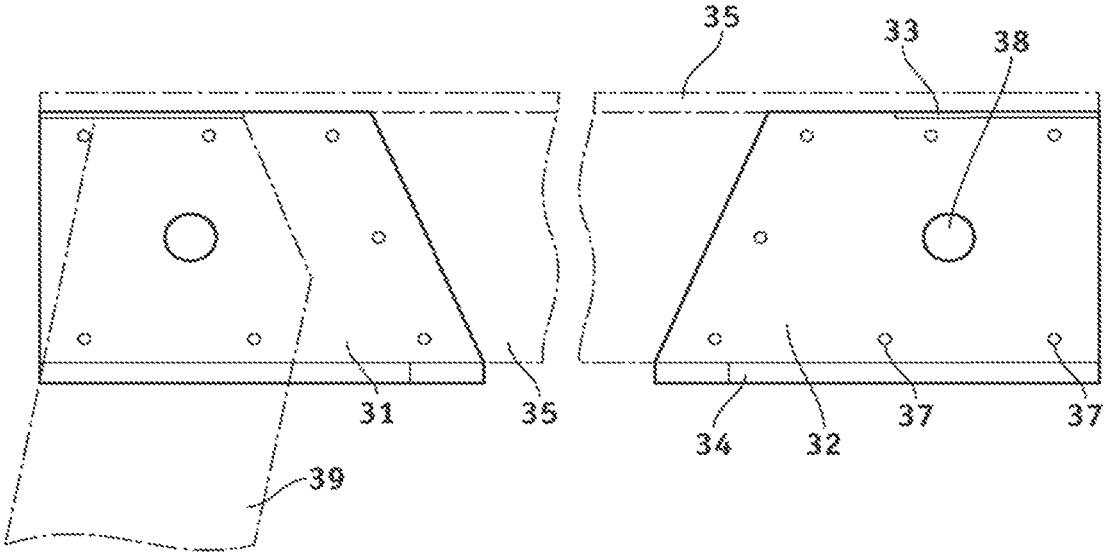
FIG. 24 illustrates a side view of a pair of brackets according to some embodiments.

FIG. 24 illustrates a first portion 31 of a bracket, a second portion 32 of the bracket, a guide and stop 33 for the leg top, a leg spreader 34 to spread and stabilize the legs, a beam 35, apertures 37, axis spring aperture 38, and a leg 39.

Figure 25:
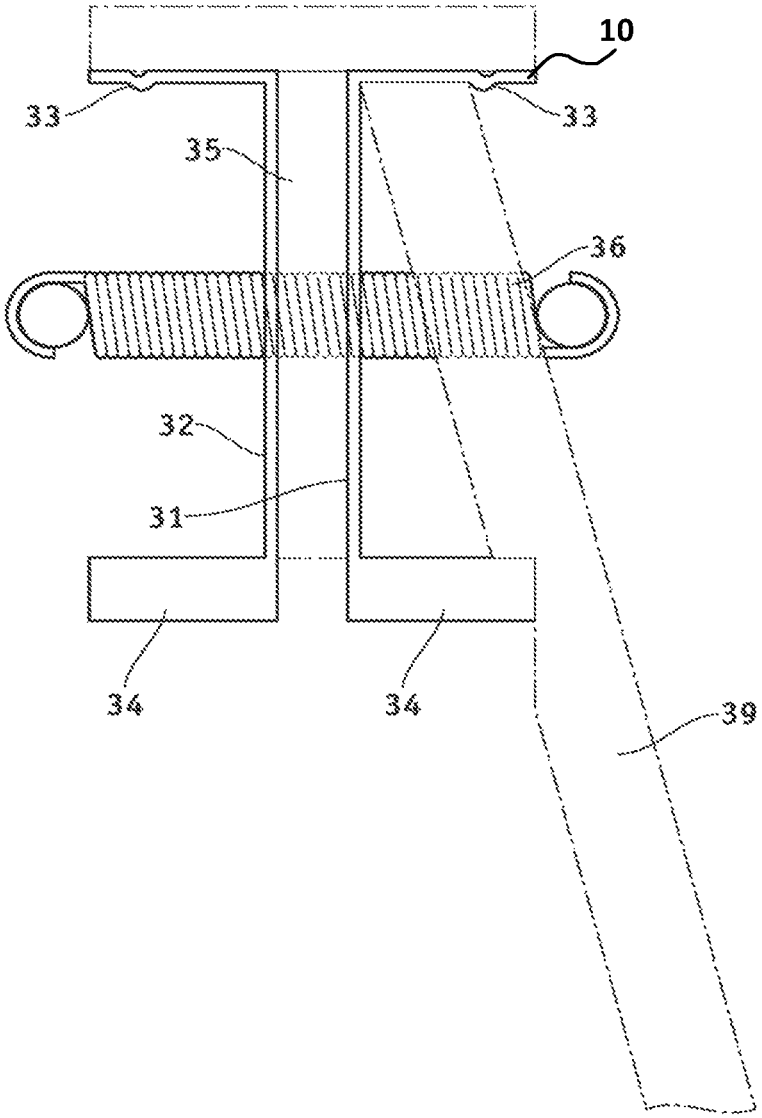
FIG. 25 illustrates an end view of the end of the saw horse according to FIG. 24.

FIG. 25 illustrates a first portion 31 of a bracket, a second portion 32 of the bracket, a guide and stop 33 for the leg top, a leg spreader 34 to spread and stabilize the legs, a beam 35, a flexible axis 36 and a leg 39.

Figure 27:
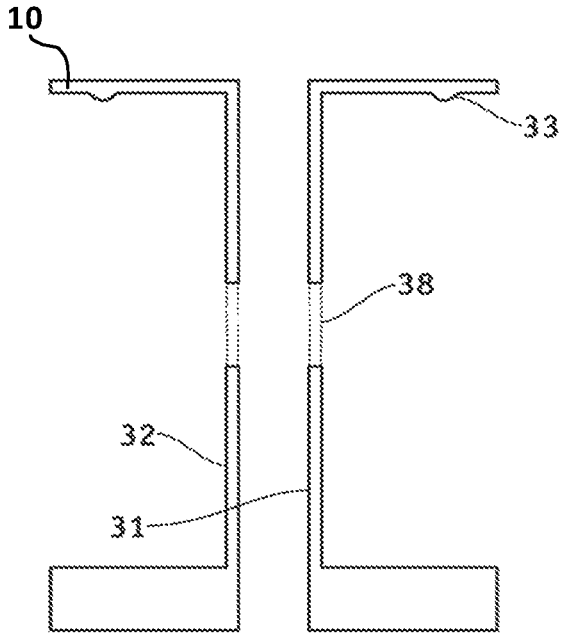
FIG. 27 illustrates an end view of the brackets according to FIG. 24.

FIG. 27 is an end view from the center of the beam looking out toward the end of the beam and illustrates a first portion 31 of a bracket, a second portion 32 of the bracket, a guide and stop 33 for the leg top, and axis spring aperture 38.

Figure 28:
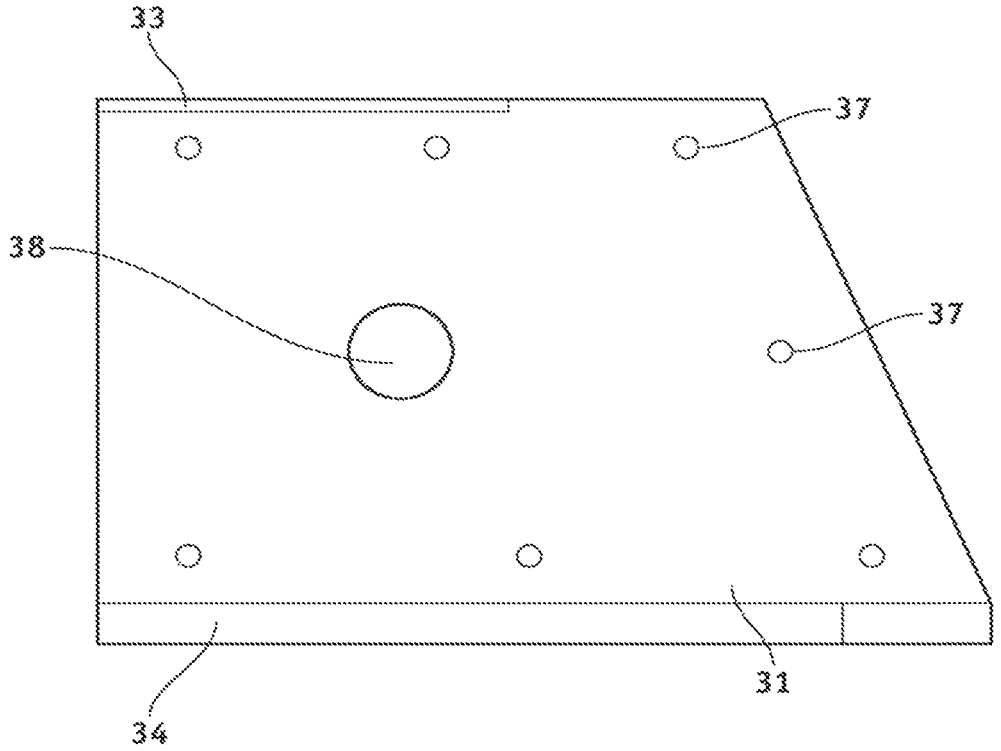
FIG. 28 illustrates a side view of a saw horse in an open position according to FIG. 24.

FIG. 28 illustrates a first portion 31 of a bracket, a guide and stop 33 for the leg top, a leg spreader 34 to spread and stabilize the legs, apertures 37, and axis spring aperture 38.

Figure 26:
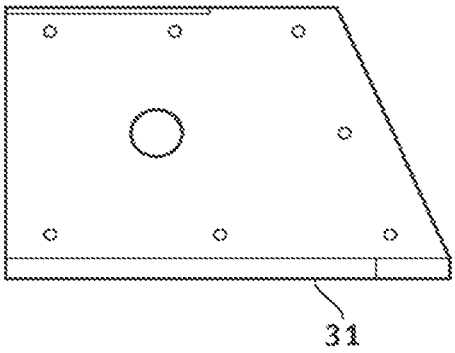
FIG. 26 illustrates a side view of a bracket according to FIG. 24.

FIG. 26 illustrates the first portion 31 of the bracket.

Figure 29:
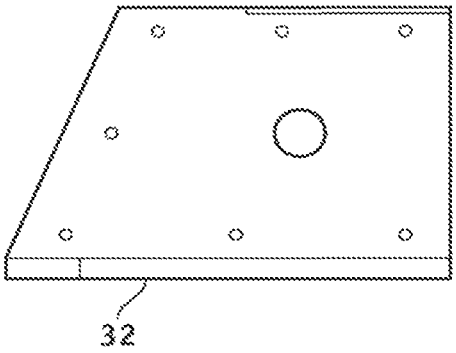
FIG. 29 illustrates an end view of the saw horse according to FIG. 24.

FIG. 29 illustrates the second portion 32 of the bracket.

Figure 30:
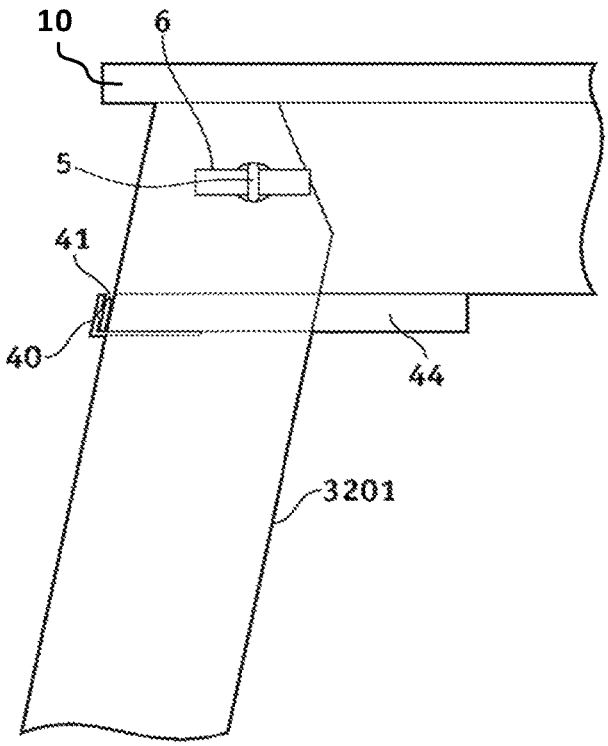
FIG. 30 illustrates a side view of the saw horse in the open position.

FIG. 30 illustrates a side view of the saw horse which may include a beveled leg spacer 44 which has beveled sides in order to cooperate with the legs 3201 in the open position. FIG. 30 further illustrates a leg latch 41 which is pivotally connected to one leg 3201. FIG. 30 also shows an angled stabilizer bracket 40 which cooperates with leg latch 41 to stabilize the legs 3201 in a traverse direction. The angled stabilizer bracket 40 defines a narrow slot in conjunction with the leg spacer 44 in which the leg latch 41 is positioned when the leg latch 41 connects the leg 3201 and its mirrored leg 3201 when the saw horse is in the open position. FIG. 30 further illustrates the retainer pin 6 which secures the flexible axis biasing device 5 in place.

Figure 32:
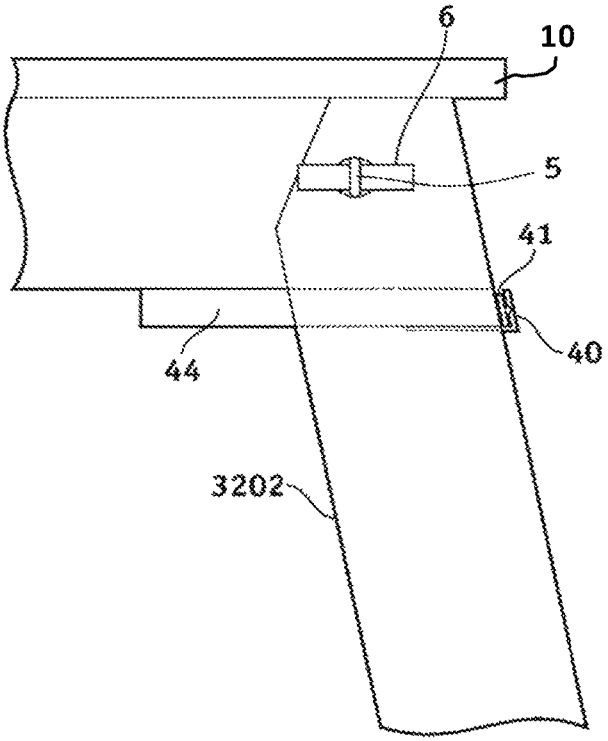
FIG. 32 illustrates another side view of the saw horse in the open position.
Figure 38:
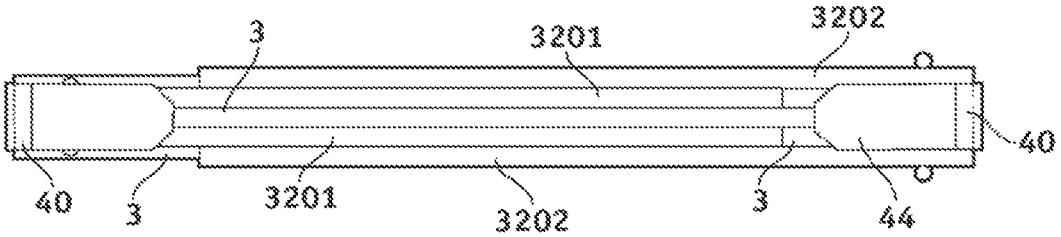
FIG. 38 illustrates a bottom view of the saw horse with a beveled leg spacer according to the embodiment of FIG. 30.

FIG. 32 illustrates a side view of one end of the saw horse, right end of FIG. 38, which may include a beveled leg spacer 44 which has beveled sides in order to cooperate with the legs 3202 in the open position. FIG. 32 further illustrates a leg latch 41 which is pivotally connected to one leg 3202. FIG. 32 also shows an angled stabilizer bracket 40 which cooperates with leg latch 41 to stabilize the legs 3202 in a traverse direction. The angled stabilizer bracket 40 defines a narrow slot in conjunction with the leg spacer 44 in which the leg latch 41 is positioned when the leg latch 41 connects the leg 3202 and its mirrored leg 3202 when the saw horse is in the open position. FIG. 32 further illustrates the retainer pin 6 which secures the flexible axis biasing device 5 in place.

Figure 31:
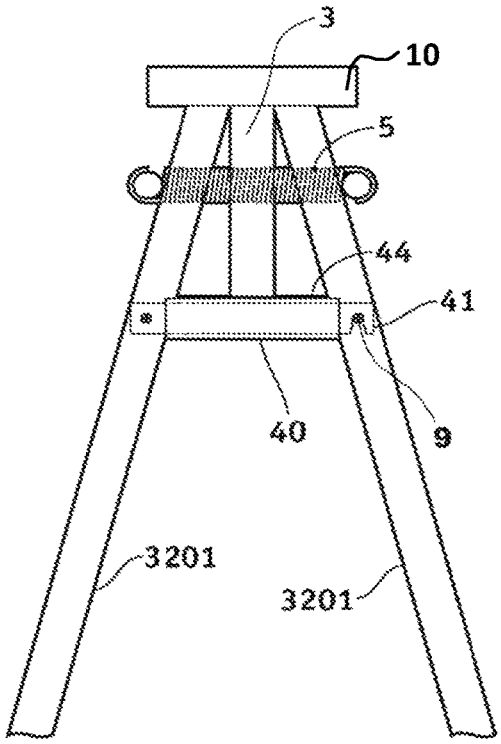
FIG. 31 illustrates an end view of a portion of the end of the saw horse according to FIG. 30.

FIG. 31 illustrates an end view of the saw horse, left side in FIG. 38, with a beveled leg spacer 44 which has beveled sides to cooperate with the legs 3201 in the open position. FIG. 31 further illustrates a leg latch 41 which is pivotally connected to one leg and an angled stabilizer bracket 40 which cooperates with the leg latch 41 to stabilize the legs 3201 in a traverse direction. The angled stabilizer bracket 40 defines a narrow slot in conjunction with the leg spacer 44 in which the leg latch 41 is positioned when the leg latch 41 connects the leg 3201 and its mirrored leg 3201 in the open position. FIG. 31 also illustrates the catch 9 which cooperates with the leg latch 41 to connect the first leg 3201 to the mirrored first leg 3201 and the second leg 3202 to the mirrored second leg 3202, shown in FIG. 33. FIG. 31 further illustrates the flexible axis biasing device 5 to connect the first leg 3201 to the mirrored first leg 3201 and to the beam 3.

Figure 33:
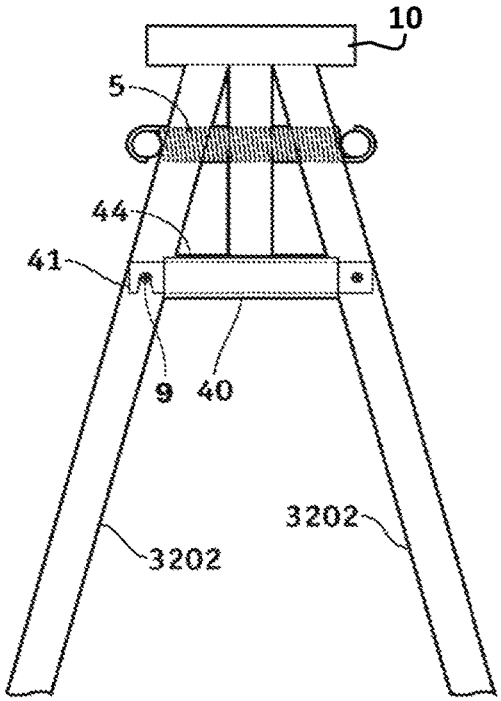
FIG. 33 illustrates cross-sectional view of a portion of the other end of the saw horse according to FIG. 30.

FIG. 33 illustrates an end view of the saw horse, right side in FIG. 38, with a beveled leg spacer 44 which has beveled sides to cooperate with the legs 3202 in the open position. FIG. 33 further illustrates a leg latch 41 which is pivotally connected to one leg and an angled stabilizer bracket 40 which cooperates with the leg latch 41 to stabilize the legs 3202 in a traverse direction. The angled stabilizer bracket 40 defines a narrow slot in conjunction with the leg spacer 44 in which the leg latch 41 is positioned when the leg latch 41 connects the leg 3202 and its mirrored leg 3202 in the open position. FIG. 33 also illustrates the catch 9 which cooperates with the leg latch 41 to connect the second leg 3202 to the mirrored second leg 3202, and the first leg 3201 to the mirrored first leg 3201, not shown in FIG. 33. FIG. 33*a* further illustrates the flexible axis biasing device 5 to connect the second leg 3202 to the mirrored second leg 3202 and to the beam 3.

Figure 34A:
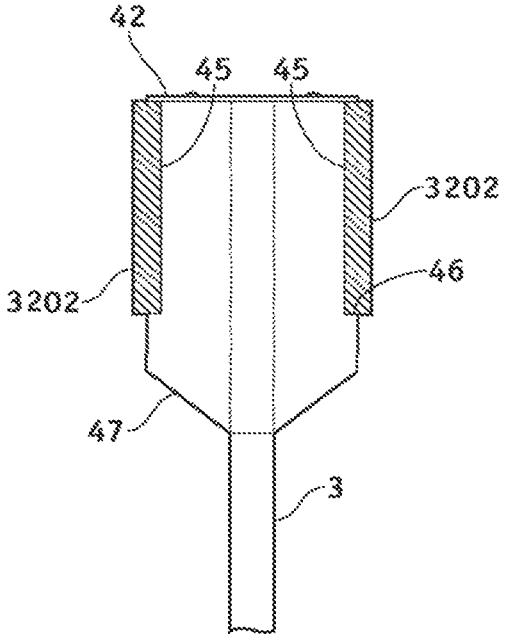
FIG. 34*a* illustrates a bottom view of a portion of one end of the saw horse from the bottom according to the embodiment shown in FIG. 39.
Figure 34B:
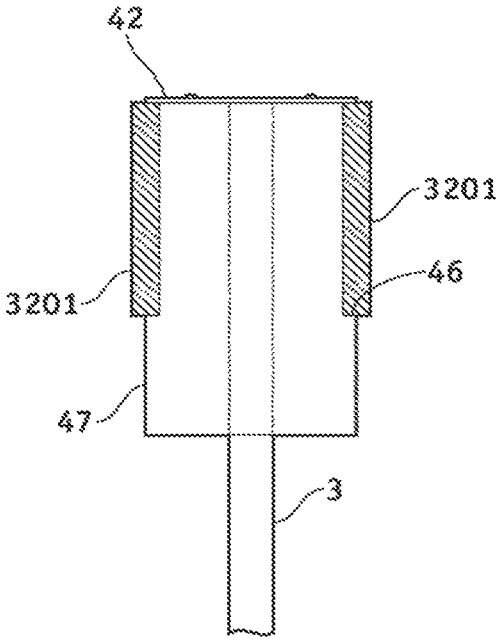
FIG. 34*b* illustrates a bottom view of a portion of the other end of the saw horse from the bottom according to the embodiment shown in FIG. 39.
Figure 39:
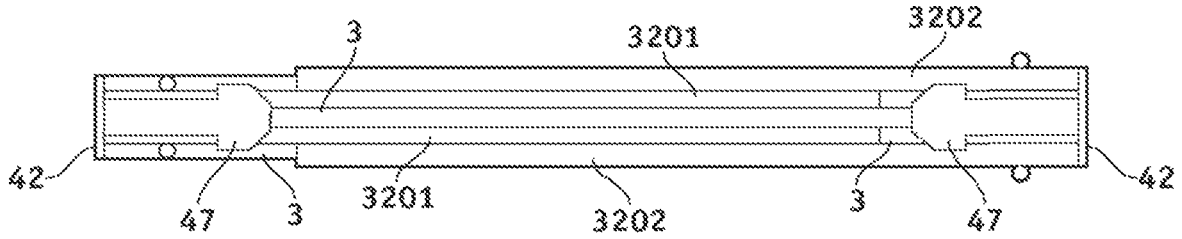
FIG. 39 illustrates a bottom view of the saw horse with a notched leg spacer.

FIG. 34*b* illustrates a bottom view and shows a cross section of a portion of one end of the saw horse, left side in FIG. 39, and illustrates the notched spacer 47 which may include opposing notches to cooperate with the legs when the saw horse is in the open position. FIG. 34*b* further illustrates the exterior stop 42 which cooperates with the interior stop 46 (a shoulder) to stabilize the legs 3201 in a traverse direction when the saw horse is in the open position.

FIG. 34*a* illustrates a bottom view and shows a cross section of a portion of one end of the saw horse, right side in FIG. 39, and illustrates the notched spacer 47 which may include opposing notches to cooperate with the legs when the saw horse is in the open position. FIG. 34*a* further illustrates the exterior stop 42 which cooperates with the interior stop 46 (a shoulder) to stabilize the legs 3202 in a traverse direction when the saw horse is in the open position.

Figure 35A:
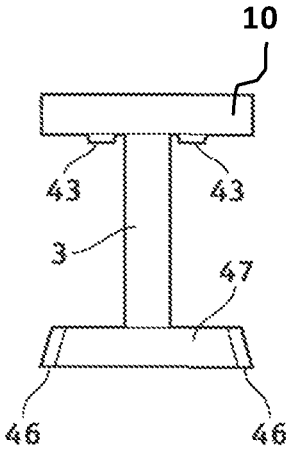
FIG. 35*a* illustrates a side view of a portion of the end of the saw horse from the end according to the embodiment shown in FIG. 39.
Figure 35B:
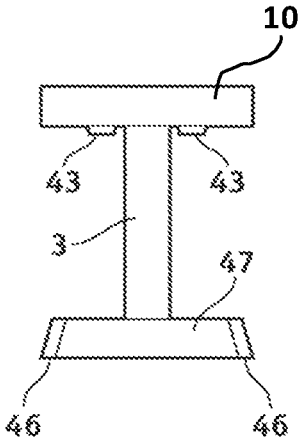
FIG. 35*b* illustrates a side view of a portion of the other end of the saw horse from the end according to the embodiment shown in FIG. 39.

FIG. 35*b* illustrates an end view of a cross section of a portion of the end of the saw horse, left side in FIG. 39, from the end. FIG. 35*b* further illustrates the notched spacer 47, the interior stop 46, and the upper stop 43.

FIG. 35*a* illustrates an end view of a cross section of a portion of the end of the saw horse, right side in FIG. 39, from the end. FIG. 35*a* further illustrates the notched spacer 47, the interior stop 46, and the upper stop 43.

Figure 36A:
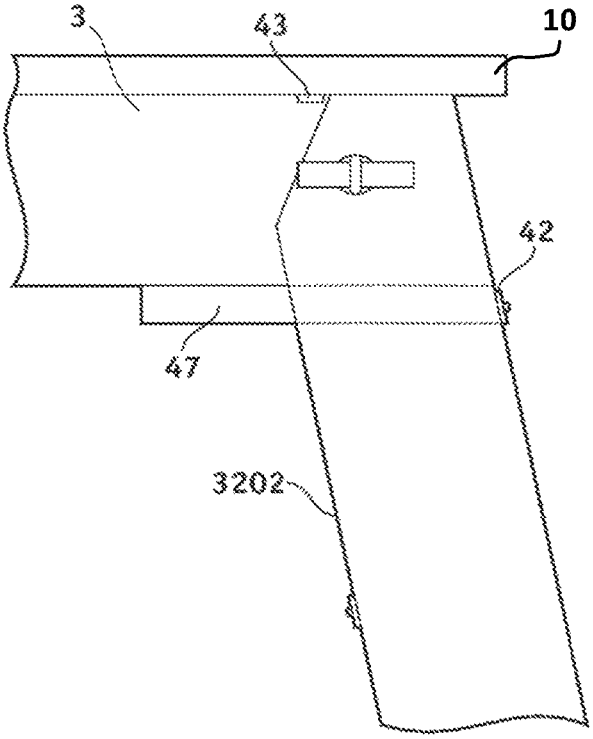
FIG. 36*a* illustrates a side view of one end of the saw horse according to the embodiment of FIG. 39.
Figure 36B:
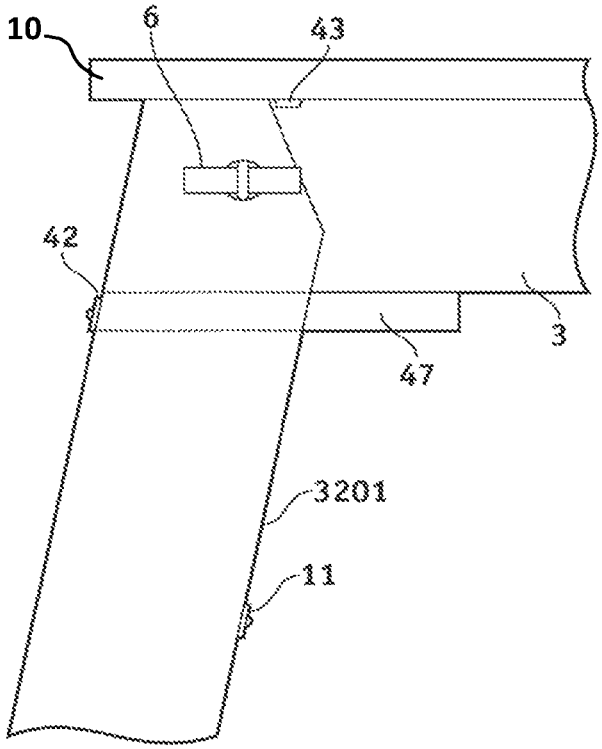
FIG. 36*b* illustrates a side view of the other end of the saw horse according to the embodiment of FIG. 39.

FIG. 36*b* illustrates a side view of an end of the saw horse, left side in FIG. 39. FIG. 36*b* further illustrates the upper stop 43 and the exterior stop 42 which work in conjunction with each other and with the interior stop 46 to stabilize the legs in the open position. FIG. 36*b* also illustrates the leg latch 11 which connects and stabilizes the legs 3201. FIG. 36*b* further illustrates the legs and the beam 3.

FIG. 36*a* illustrates a side view of an end of the saw horse, right side in FIG. 39. FIG. 36*a* further illustrates the upper stop 43 and the exterior stop 42 which work in conjunction with each other and with the interior stop 46 to stabilize the legs in the open position. FIG. 36*a* also illustrates the leg latch 11 which connects and stabilizes the legs. FIG. 36*a* further illustrates the legs and the beam 3.

Figure 37A:
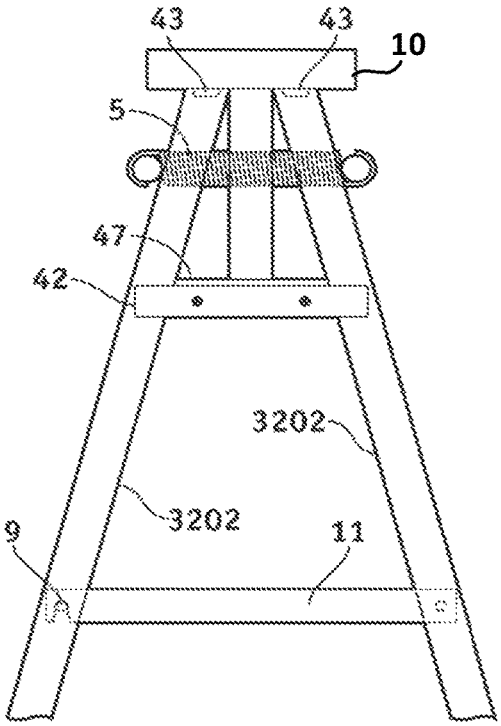
FIG. 37*a* illustrates an end view the saw horse according to the embodiment of FIG. 39.
Figure 37B:
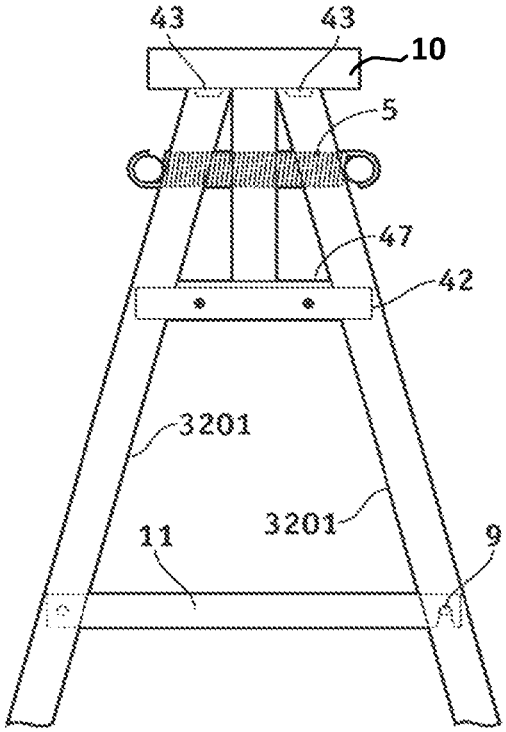
FIG. 37*b* illustrates an end view of the other end of the saw horse according to the embodiment of FIG. 39.

FIG. 37*b* illustrates an end of the saw horse in the open position, left side in FIG. 39. FIG. 37*b* further illustrates the upper stop 43 and the exterior stop 42 which work in conjunction with each other and with the interior stop 46, as illustrated in FIG. 34, to stabilize the legs in the open position. FIG. 37*b* also illustrates the leg latch 11 detachably connected to the catch 9 to connect and stabilize the legs.

FIG. 37*a* illustrates an end of the saw horse in the open position, right side in FIG. 39. FIG. 37*a* further illustrates the upper stop 43 and the exterior stop 42 which work in conjunction with each other and with the interior stop 46, as illustrated in FIG. 34*a*, to stabilize the legs in the open position. FIG. 37 also illustrates the leg latch 11 detachably connected to the catch 9 to connect and stabilize the legs.

FIG. 38 illustrates a bottom view of the saw horse in the stowed position showing the center beam 3, the second leg 3202 on the outside and adjacent to the first leg 3201 which may be adjacent to the center beam 3 which may be adjacent to the mirrored first leg 3201, which may be adjacent to the mirrored second leg 3202, which may be on the outside. The beveled leg spacer 44 is additionally shown in FIG. 38. FIG. 38 further illustrates the angled stabilizer brackets 40 which cooperate with the leg latches 41, not shown, to stabilize the legs 3202 and legs 3201 in a traverse direction when the saw horse is in the open position.

FIG. 39 illustrates a bottom view of the saw horse in the stowed position showing the center beam 3, the second leg 3202 on the outside and adjacent to the first leg 3201 which may be adjacent to the center beam 3 which may be adjacent to the mirrored first leg 3201, which may be adjacent to the mirrored second leg 3202, which may be on the outside. The notched leg spacer 47 is additionally shown in FIG. 39. FIG. 39 further illustrates the exterior stops 42 which work in conjunction with the upper stops 43, not shown in FIG. 39, and with the interior stop 46, not shown in FIG. 39, to stabilize the legs 3202 and legs 3201 in a traverse direction when the saw horse is in the open position.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A saw horse comprising:

a beam with a first leg spacer and a second leg spacer;

a first pair of legs having top ends and bottom ends;

a second pair of legs having top ends and bottom ends;

a first flexible connector to rotatingly connect the first pair of legs to the beam;

wherein the first flexible connector allows rotation of the first pair of legs between an open position and a stowed position, a second flexible connector to rotatingly connect the second pair of legs to the beam;

wherein the second flexible connector allows rotation of the second pair of legs between an open position and a stowed position, wherein the first pair of legs and the second pair of legs, while in the stowed position are disposed along the beam;

wherein the first pair of legs and the second pair of legs, while in the open position are disposed downwardly and outwardly to support the beam;

wherein the first flexible connector is configured and arranged to pull together the top ends of the first pair of legs against the first leg spacer thereby extending the bottom ends of the first pair of legs outward from each other while in the open position;

wherein the second flexible connector is configured and arranged to pull together the top ends of the second pair of legs against the second leg spacer thereby extending the bottom ends of the second pair of legs outward from each other while in the open position.

2. The saw horse of claim 1 wherein, the first pair of legs and the second pair of legs include leg notches, and wherein the leg notches are configured to contact the first leg spacer and the second leg spacer to stabilize the first pair of legs and the second pair of legs when in the open position.

3. The saw horse of claim 1 further comprising:

wherein the first flexible connector and the second flexible connector are each a spring adapted to flex when moving between the open position and the stowed position;

wherein the first flexible connector and the second flexible connector each pass through an aperture in the beam; and wherein the first pair of legs, while in the stowed position are disposed side-by-side on opposing peripheral sides of the beam and the second pair of legs, while in the stowed position, are disposed side-by-side on opposing sides of the first pair of legs disposed along the beam.

4. The saw horse of claim 3 further comprising:

a flexible handle connected to the beam;

a first leg latch connected to one of the legs of the first pair of legs; and a first leg latch catch connected to the other of the first pair of legs; and a second leg latch connected to one of the legs of the second pair of legs; and a second leg latch catch connected to the other of the second pair of legs.

5. The saw horse of claim 1 wherein:

the first flexible connector passes through a first aperture in the beam and the second, flexible connector passes through a second aperture in the beam.

6. The saw horse of claim 1 further comprising:

the first pair of legs, while in the stowed position, are disposed side-by-side on opposing peripheral sides of the beam and the second pair of legs, while in the stowed position, are disposed side-by-side on opposing sides of the first pair of legs disposed along the beam.

7. The saw horse of claim 1 wherein:

the first leg spacer and the second leg spacer are notched spacers, wherein each of the notched spacers include a first notch and a second side notch, wherein the first pair of legs, when in the open position, are positioned in the first side notch and the second side notch of the first leg spacer to stabilize the first pair of legs, and wherein the notched spacers each comprise an exterior stop and an interior stop, wherein the exterior stop cooperates with the interior stop to stabilize the first pair of legs and the second pair of legs while in the open position.

8. The saw horse of claim 2 wherein:

the first pair of legs and the second pair of legs rotate and traversely extend and retract to move between the open position and the stowed position; and the first flexible connector and the second flexible connector flex when moving between the open position and the stowed position.

9. The saw horse of claim 8 wherein: the first flexible connector comprises a first spring, and wherein the second flexible connector comprises a second spring.

10. The saw horse of claim 2 wherein:

the beam includes a work piece-supporting flange above the first leg spacer and the second leg spacer, the top ends of the first pair of legs and the top ends of the second pair of legs contact the workpoece supporting flange while the first pair of legs and the second pair of legs are in the open position.

11. A saw horse to support a work piece comprising:

a beam to support the work piece wherein the comprises at least a portion of the beam including a T shape including a work piece-supporting flange;

a first pair of legs to support the beam and the work piece;

a first flexible connector to attach the first pair of legs to a first end of the beam with one of the first pair of legs on either side of the beam;

a second pair of legs to support the beam and the work piece;

a second flexible connector to attach the second pair of legs to a second end of the beam with one of the second pair of legs on either side of the beam;

wherein the first flexible connector and the second flexible connector are adapted to rotate the first pair of legs and the second pair of legs between an open position and a nested position, wherein the first pair of legs and the second pair of legs, while in the open position, are extended and contact the work piece-supporting flange to support the beam, wherein the first pair of legs, while in the nested position, are disposed side-by-side on opposing peripheral sides of the beam and the second pair of legs, while in the nested position, are disposed side-by-side on opposing sides of the first pair of legs disposed along the beam.

12. The saw horse of claim 11 wherein:

the first pair of legs and the second pair of legs include top ends and bottom ends;

the first flexible connector and the second flexible connector are springs adapted to flex when moving between the open position and the nested position;

the first flexible connector and the second flexible connector pass through apertures in the beam; and the first flexible connector and the second flexible connector, when in the open position, pull together the top ends to lever the first pair of legs and the second pair of legs against the beam thereby extending the bottom ends outward from each other.

13. A saw horse to support a work piece comprising:

a beam to support the work piece, wherein the beam comprises a beam width and at least a portion of the beam including a T shape including a work piece-supporting flange;

a first pair of legs to support the beam and the work piece;

a first flexible connector to attach the first pair of legs to a first end of the beam with one of the first pair of legs on either side of the beam;

a second pair of legs to support the beam and the work piece;

a second flexible connector to attach the second pair of legs to a second-end of the beam with one of the second pair of legs on either side of the beam;

wherein the first flexible connector and the second flexible connector are adapted to rotate the first pair of legs and the second pair of legs between an open position and a nested position, wherein the first pair of legs and the second pair of legs, while in the open position, are extended and contact the work piece-supporting flange, wherein the first pair of legs and the second pair of legs support the beam, wherein the first pair of legs and the second pair of legs, while in the nested position, are nested entirely within a nesting width that is not greater than the beam width.

14. The saw horse of claim 13 wherein:

wherein the saw horse is structured and arranged to support a weight of the work piece supported by the beam while the saw horse is in the open position even when the first flexible connector and the second flexible connector are absent from the saw horse.

15. The saw horse of claim 14 wherein:

the first pair of legs, while in the nested position, are disposed side-by-side on opposing peripheral sides of the beam and the second pair of legs, while in the nested position, are disposed side-by-side on opposing sides of the first pair of legs disposed along the beam;

wherein the beam comprises a beam width and at least a portion of the beam includes an I shape;

wherein the first pair of legs and the second pair of legs, while in the nested position, are nested within a nested width that is not greater than the beam width.

16. The saw horse of claim 15 wherein:

the first pair of legs and the second pair of legs include top ends and bottom ends;

the first flexible connector and the second flexible connector are springs adapted to flex when moving between the open position and the nested position;

the first flexible connector and the second flexible connector passes through apertures in the beam; and the first flexible connector and the second flexible connector are adapted to pull together the top ends to lever the first pair of legs and the second pair of legs against the beam thereby extending the bottom ends outward from each other.

17. A saw horse to support a work piece comprising:

a beam to support the work piece, wherein at least a portion of the beam comprises an I shape including a work piece-supporting flange and a leg-separating flange;

a first pair of legs and a second pair of legs to support the beam, wherein each leg, of the first pair of legs and the second pair of legs has a top end and a bottom end; and a first spring to attach the first pair of legs to the beam with one leg of the second pair of legs on either side of the beam;

a second spring to attach the second pair of legs to the beam with one leg of the secnond pair of legs on either side of the beam;

wherein the first spring and the second spring are adapted to pull the top ends of each leg inwardly;

wherein first pair of legs and the second pair of legs contact the work piece-supporting flange of the beam and are configured and arranged to bear a weight of the work piece supported by the beam.

18. The saw horse of claim 17 wherein:

the first spring passes through a first aperture in the beam;

the second spring passes through a second aperture in the beam; and the first pair of legs and the second pair of legs are adapted to pivot around the leg-separating flange of the I shape until the top end of each leg contacts the work piece-supporting flange of the I shape.

19. The saw horse of claim 18 wherein:

the first pair of legs and the second pair of legs are adapted to pivot away from the leg-separating flange of the I shape to dispose the first pair of legs and second pair of legs side-by-side on opposing peripheral sides of the beam.

20. The saw horse of claim 19 further comprising:

a first latch to latch together the first pair of legs;

a second latch to latch together the second pair of legs;

wherein the first pair of legs and the second pair of legs are adapted to pivot around the leg-separating flange of the I shape while engaging the first spring and the second spring until the top end of each leg holds against the work piece-supporting flange of the I shape and while the first latch latches the first pair of legs in place and while the second latch latches the second pair of legs in place.

21. The saw horse of claim 19 further comprising:

at least one stabilizer on each leg of the first pair of legs and the second pair of legs to stabilize the first pair of legs and the second pair of legs and the beam, whenever the first pair of legs and the second pair of legs are in an open position, wherein the stabilizer mates flush with the leg-separating flange of the I shape.

22. The saw horse of claim 21 wherein the at least one stabilizer comprises at least one notch.

23. A saw horse to support a work piece comprising:

a beam to support the work piece, wherein at least a portion of the beam comprises an I shape with a work piece-supporting flange and a leg-separating flange;

two pairs of legs positioned on opposite sides and opposite ends of the beam, wherein the two pairs of legs have top ends and bottom ends; and two flexible connectors to attach the top ends of each pair of the two pairs of legs to the beam between the work piece-supporting flange and the leg-separating flange;

wherein the two flexible connectors are adapted to rotate the two pairs of legs between a nested position and an open position and the two flexible connectors flex when moving between the open position and the nested position;

wherein the two pairs of legs and the beam, while in the nested position, are dispsosed against each other;

wherein the two pairs of legs, while in the nested position, are disposed between the work piece-supporting flange and the leg-separating flange;

wherein the two pairs of legs, while in the open position, are disposed angularly opposed to the beam;

wherein at least a portion of the two pairs of legs, while in the open position, are disposed flush with at least a portion of at least one of the work piece-supporting flange and the leg-separating flange such that a weight of the work piece upon the beam transfers directly to the two pairs of legs;

wherein, when the two pairs of legs move from the nested position to the open position, the two flexible connectors pull the top ends of the two pairs of legs together to spread the bottom ends by levering against the leg-separating flange;

wherein the saw horse is structured and arranged to support the weight of the work piece supported by the beam while the saw horse is in the open position.

24. The saw horse of claim 23 wherein: the two flexible connectors are springs.

25. The saw horse of claim 23 wherein: the two flexible connectors are flexible axis biasing devices.

26. The saw horse of claim 23 further comprising:

at least one notch disposed on each leg that mates flush with at least one surface of the leg-separating flange.

27. The saw horse of claim 23:

wherein, when the two pairs of legs are in the open position, the top ends of the two pairs of legs comprise at least one flat surface to lay flat with an underside of the work piece-supporting flange.

28. The saw horse of claim 23 further comprising:

at least two apertures in the beam to allow the two flexible connectors to pass through the beam to connect the two pairs of legs to the beam in pairs.

29. The saw horse of claim 28 further comprising:

at least two latches to latch together the two pairs of legs below the leg-separating flange when the two pairs of legs are in the open position.

30. The saw horse of claim 29 further comprising:

at least one notch disposed on each leg of the two pairs of legs, wherein, when in the open position, the notch mates flush with at least one surface of the leg-separating flange;

wherein, when the two pairs of legs are in the open position, the top ends of the two pairs of legs comprise at least one flat surface to lay flat with an underside of the work piece-supporting flange;

wherein the two flexible connectors are springs.

* * * * *